United States Patent [19]

Van Der Burgt et al.

[11] Patent Number: 4,952,846

[45] Date of Patent: Aug. 28, 1990

[54] CIRCUIT ARRANGEMENT FOR OPERATING A HIGH-PRESSURE SODIUM DISCHARGE LAMP

[75] Inventors: Petrus J. M. Van Der Burgt; Hilbert Palmers, both of Eindhoven, Netherlands

[73] Assignee: U. S. Philips Corporation, New York, N.Y.

[21] Appl. No.: 877,611

[22] Filed: Jun. 23, 1986

[51] Int. Cl.[5] ..... H05B 37/02

[52] U.S. Cl. ..... 315/209 R; 315/307; 315/194; 315/308; 315/227 R

[58] Field of Search ..... 315/311, 307, 291, 284, 315/194, 199, 227 R, 258, 247, 293, 308, 363, DIG. 4, DIG. 5

[56] References Cited

U.S. PATENT DOCUMENTS

| | | | |
|---|---|---|---|
| 3,989,976 | 11/1976 | Tabor | 315/DIG. 4 |
| 4,162,429 | 7/1979 | Elms et al. | 315/284 |
| 4,475,065 | 10/1984 | Bhalla et al. | 315/227 R |

*Primary Examiner*—Leo H. Boudreau
*Assistant Examiner*—Michael Razavi
*Attorney, Agent, or Firm*—Bernard Franzblau

[57] ABSTRACT

A circuit arrangement for operating at a supply voltage $V_n$ a high-pressure sodium discharge lamp (4) having a lamp voltage $V_{la}$ in conjunction with a current limiter circuit (3) and a first controlled semiconductor switching element (1). The circuit arrangement comprises a first part of comparing a proportional part of the lamp voltage $V_{la}$ with a reference voltage $V_r$ and a second part for comparing a proportional part of the supply voltage $V_n$ with the resultant of the first comparison. The circuit arrangement makes it possible to operate the lamp so that the lamp voltage $V_{la}$ is substantially constant.

17 Claims, 1 Drawing Sheet

CIRCUIT ARRANGEMENT FOR OPERATING A HIGH-PRESSURE SODIUM DISCHARGE LAMP

BACKGROUND OF THE INVENTION

This invention relates to a circuit arrangement suitable for operating at a supply voltage $V_n$ a high-pressure discharge lamp having a lamp voltage $V_{la}$ in conjunction with a current limiter circuit and with a first controlled semiconductor switching element provided with a control electrode connected to a control circuit of the circuit arrangement.

The terms "lamp voltage $V_{la}$" and "supply voltage $V_n$" are to be understood in this description and the claims to mean the value of the root of the time-averaged square of the value of the actual lamp voltage and supply voltage, respectively, i.e. the so-called R.M.S. value. The lamp voltage $V_{la}$ is the voltage across the lamp in the stable operating condition of the lamp.

The term "supply voltage $V_n$" is also to be understood to mean in this description and the claims that voltage to which the combination of the current limiter circuit and the lamp is connected. The current limiter circuit may be constituted by a single stabilization ballast, such as a self-inductance. A semiconductor switching circuit, such as, for example, an up-converter or a down-converter, as the case may be in conjunction with a converter, is also possible.

A circuit arrangement of the kind mentioned in the opening paragraph is known from U.S. Pat. No. 4,475,065. In the known circuit arrangement, the first controlled semiconductor switching element is controlled so that during the lifetime of the lamp the power consumed by the lamp decreases in dependence upon the increase of the lamp voltage $V_{la}$. Thus, it is possible for the lifetime of the lamp to be lengthened. Other parameters of the lamp, such as the general colour rendition index $R_a$ and the colour temperature $T_c$ of radiation emitted by the lamp, will vary under the influence of the known control. However, in many cases, for example in public illumination, these parameters play a substantially negligible part. This is quite different in those high-pressure sodium discharge lamps which are suitable for use as an interior illumination lamp, for example for illumination of sporting-halls or as a light source in a living-room. With the use as an interior illumination lamp, both the colour rendition index $R_a$ and the colour temperature $T_c$ are of great importance. It is therefore very important that these parameters remain constant or substantially constant during the life of the lamp. However, it is known that the colour temperature $T_c$ of the emitted radiation varies and more particularly decreases with the use of the known arrangement.

SUMMARY OF THE INVENTION

The invention therefore has for an object to provide a circuit arrangement comprising means for operating a high-pressure sodium discharge lamp in such a way that in an efficient manner the colour temperature $T_c$ varies only slightly during the lifetime of the lamp.

For this purpose, a circuit arrangement of the kind mentioned in the opening paragraph is characterized in that the circuit arrangement further comprises means for operating the lamp so that the lamp voltage $V_{la}$ is substantially constant, these means comprising a first part including a first comparison circuit for comparing a proportional part of the lamp voltage $V_{la}$ with a reference voltage $V_r$, and a second part including a second comparison circuit for comparing a proportional part of the supply voltage $V_n$ with the voltage at an output terminal of the first comparison circuit, the second comparison circuit having an output terminal which is electrically connected to an input terminal of the control circuit.

An advantage of the invention is that the colour temperature $T_c$ of the emitted radiation of the operated lamp remains substantially constant during the lifetime of the lamp. The invention has the further advantage that by adjustment of the reference voltage $V_r$ for an individual lamp the value of the lamp voltage $V_{la}$ associated with a value of the colour temperature $T_c$ is adjustable. Thus, it is possible to compensate for a spread in the colour temperature $T_c$ between individual lamps at the same lamp voltage $V_{la}$.

The colour temperature $T_c$ of the emitted radiation is related to the pressure of the sodium in the discharge vessel of the lamp. In the case of an excess filling of the discharge vessel, the sodium pressure is determined by the temperature of the sodium present in excess. The filling of the discharge vessel of high-pressure sodium discharge lamps generally consists of a sodium-mercury amalgam and a rare gas. The amalgam is then of importance for the lamp voltage $V_{la}$ because $V_{la}$ is a function of the relative Na and Hg pressure. As far as the Na pressure varies by causes other than disappearance of sodium, it is possible by keeping the lamp voltage $V_{la}$ constant to also keep constant the Na pressure.

A further advantage of the circuit arrangement is that, besides a variation of the lamp voltage $V_{la}$ variations in the supply voltage $V_n$ also directly influence the control of the first controlled semiconductor switching element. Thus, a very accurate control is obtained.

In a first preferred embodiment of a circuit arrangement according to the invention, the first comparison circuit comprises a first integrator with an integration time $\tau_g \geqq 45$ s.

In a second preferred embodiment, the second part of the circuit arrangement comprises a second integrator with an integration time $\tau_k \leqq 10$ ms. Thus, it is achieved that variations in the supply source voltage substantially cannot influence the lamp voltage, while on the other hand variations in the lamp voltage are fed back by the control arrangement without the risk of positive feedback occuring. The term "positive feedback" is to be understood to mean that with an occuring lamp voltage variation the control of the circuit arrangement ensures that the lamp voltage variation is increased.

The risk of positive feedback resides in the property of high-pressure sodium lamps that with an abrupt increase in lamp current the lamp voltage decreases abruptly and then only increases gradually to a new state of equilibrium associated with the increased lamp current. The time duration required to reach the new state of equilibrium is controlled by the thermal properties of the relevant lamp and can be expressed in a characteristic time $\tau_T$. For high-pressure sodium discharge lamps, this characteristic time $\tau_T$ is of the order of 20 ms. It appears from general principles of process control that in the case of a control on the basis of feedback there is no risk of positive feedback if the characteristic time of the control system is considerably longer than the characteristic time associated with the quantity to be controlled. This requirement with respect to the process control is fulfilled in that the first comparison circuit is provided with an integrator with an integration time $\tau_g \geqq 45$ s.

The comparatively short integration time of the second integrator ensures that a variation in the supply voltage, also abrupt variations, lead to a rapid response in the control of the first controlled semiconductor switching element. This is advantageous because an abrupt voltage variation in the absence of a control system leads to an abrupt lamp current variation, which due to the long characteristic time $\tau_T$ of this lamp type leads to a comparatively long variation of the lamp voltage $V_{la}$.

In an advantageous embodiment of the circuit arrangement according to the invention, the first comparison circuit is shunted by a second controlled semiconductor switching element, which is conductive during starting and the associated transient phase up to stable operation of the lamp.

In a simple manner, it is thus achieved in the circuit arrangement that starting and the associated transient phase up to stable operation of the lamp are not influenced by the control of the circuit arrangement because, due to the conductive state of the second controlled semiconductor switching element, the voltage at the output terminal of the first comparison circuit retains a constant value.

In high-pressure sodium discharge lamps, starting is characterized by a very unsteady operation for some time immediately after the occurrence of a first discharge. This time is generally of the order of 30 s. Subsequently, a more steady state of th discharge is obtained, but with a voltage across the lamp of about 0.25 $V_{la}$. The discharge will then be gradually developed to a discharge with a lamp voltage $V_{la}$, forming the stable operating condition. When the control of the circuit arrangement becomes immediately operative during the transient phase of the lamp, this will result in a slightly accelerated transient phase of the lamp, it is true, but due to the long integration time of the first integrator it will also lead to an overshoot of the voltage across the lamp above the adjusted value, possibly even to such an extent that the associated reignition peak becomes larger than is obtainable with the connected supply voltage $V_n$, in which event the lamp extinguishes.

In a first advantageous embodiment, a control electrode of the second controlled semiconductor switching element is connected to an output terminal of a counter circuit, of which an input terminal is connected to the control circuit. When in the counter circuit a threshold value is adjusted, it is achieved in a reliable and comparatively simple manner that the second semiconductor switching element will conduct for a constant number of cycles of the supply voltage.

In a second embodiment, a control electrode of the second controlled semiconductor switching element is connected to an output terminal of an operational amplifier circuit, which serves to compare a voltage across the lamp with an adjusted threshold value. In this manner, it is achieved that the lamp voltage control becomes operative at an adjusted value of the voltage across the lamp. This has the advantage that the lamp reaches the desired colour temperature $T_c$ rapidly and with very few fluctuations.

In a further advantageous embodiment of the circuit arrangement, the control circuit comprises an opto-coupler. This has the advantage that a D.C. separation is obtained between the first controlled semiconductor switching element and the circuit arrangement by means of an element suitable for integration.

The circuit arrangement may be constructed as a separate arrangement. However, it is possible that the circuit arrangement is incorporated into the lamp, for example into the lamp cap, preferably together with the first controlled semiconductor switching element. It is also possible that the circuit arrangement is joined together with a current limiter circuit to form a single arrangement.

An embodiment of the invention will be described more fully with reference to the accompanying drawing, in which:

DESCRIPTION OF THE PREFERRED EMBODIMENTS

In both Figures, the circuit arrangement is joined with a first controlled semiconductor switching element and with a current limiter circuit to form a single arrangement.

Figure 1:
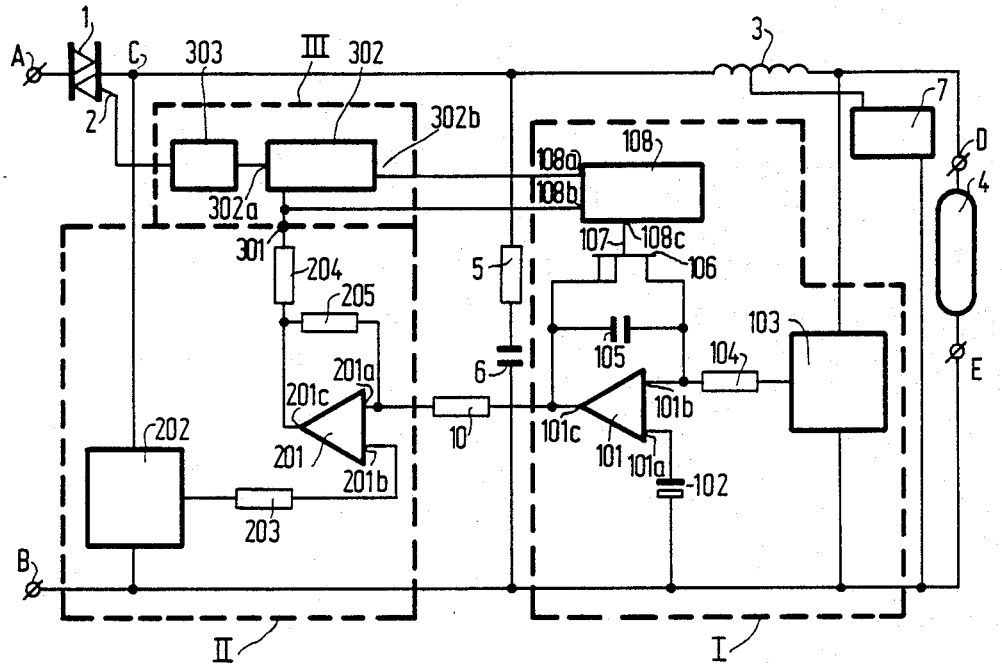
FIG. 1 shows a principle circuit diagram of a first embodiment.

In FIG. 1, A and B denote connection terminals for connection of a supply source, preferably an alternating voltage source. A lamp 4, which in the operating condition is connected between output terminals D and E, is arranged in series with a first controlled semiconductor switching element 1 provided with a control electrode 2 connected to a control circuit III of the circuit arrangement. This series arrangement further includes a stabilization ballast 3 as a current limiting circuit. A voltage at the point C is the supply voltage $V_n$ at which the combination of stabilization ballast and lamp is operated. A series-combination of a resistor 5 and a capacitor 6 is connected in parallel with the stabilization ballast 3 and the lamp 4. This series-combination serves to maintain a so-called keep-alive current through the lamp at the time when the first controlled semiconductor switching element is non-conducting. A starting circuit 7 is connected in parallel with the lamp 4 and this circuit has a connection terminal connected to the stabilization ballast 3. In the case indicated, the starting circuit 7 forms part of the arrangement. It is also possible that the starting circuit be connected between the connection terminals D,E and so it does not form a part of the arrangement.

The circuit arrangement comprises a first part I for comparing a voltage proportional to the lamp voltage $V_{la}$ with a reference voltage $V_r$. For this purpose, the first part I comprises a comparison circuit 101 having a first input terminal **101*a* to which the voltage of the auxiliary voltage source 102 is applied as the reference voltage $V_r$. The voltage proportional to the lamp voltage $V_{la}$ is applied to a second input terminal 101*b*. The voltage proportional to the lamp voltage $V_{la}$ is developed in a voltage divider circuit 103 connected parallel to the lamp 4**.

The electrical connection between the voltage divider circuit 103 and the input terminal **101*b* extends via a resistor 104, which forms an integrator together with a capacitor 105 and the comparison circuit 101. The comparator 105 is then connected electrically in parallel with the comparison circuit 101**.

A second controlled semiconductor switching element 106 is connected in parallel with the comparison circuit 101 and the capacitor 105 and a control electrode 107 of this element is connected to an output terminal 108c of a counter circuit 108. An input terminal 108a of the counter circuit 108 is electrically connected to a control circuit III of the first controlled semiconductor switching element 1.

The circuit arrangement further comprises a second part II which includes a second comparison circuit 201 having an input terminal 201a connected through a resistor 10 to the output terminal 101c of the comparison circuit 101. An input terminal 201b is connected to a voltage divider circuit 202 via a resistor 203. A voltage proportional to the supply voltage $V_n$ is produced in the voltage divider circuit 202.

An output terminal 201c of the comparison circuit 201 is connected via a resistor 204 to an input terminal 301 of the control circuit III.

The control circuit III comprises a control device 302 having the input terminal 301. An output terminal 302a is connected via a transformer 303 to the control electrode 2 of the first controlled semiconductor switching element 1. A further output terminal 302b of the control device 302 is connected to the input terminal 108a of the counter circuit 108.

In a practical embodiment of the circuit arrangement, the comparison circuits 101 and 201 are constructed as operational amplifiers. The operational amplifier 101 used is a device of the type CA 3140 marketed by R.C.A.

In order to be able to work in the first part with comparatively small currents, the combination of the operational amplifier 101, the capacitor 105 and the second controlled semiconductor switching element 106 is chosen so that, even with a long integration time, a detrimental effect of leakage currents does not occur. The second controlled semiconductor switching element may consist of a MOSFET of the type BSV 81, trademark Philips.

The capacitor 105 has a value of 6.8 $\mu$F and the resistor 104 has a value of 15 Msl. The capacitor 105 and the resistor 104, which form together with the operational amplifier 101 the first integrator of the first comparison circuit, thus have an integration time $\tau_g$ of 100 s.

The counter circuit 108 is proportioned so that on the one hand, during starting of the lamp, the first controlled semiconductor switching element 1 is switched to the conductive state as far as possible via the connection to the input terminal 301, and on the other hand after starting, but still during the associated transient phase to stable operation of the lamp, the second semiconductor switching element 106 is conductive. The time duration for starting is chosen to be 10 s and the time duration for the associated transient phase is chosen to be 1.5 minutes.

The control circuit used is an integrated circuit of the type TCA 280, trademark Philips.

The voltage divider circuit 103 is constructed as a resistor circuit.

The voltage divider circuit 202 comprises, besides a resistor circuit, also a small capacitor and thus forms at the same time a second integrator, with which a short integration time $\tau_k$ of 10 ms is realized. The resistors 10 and 205 serve to tune the amplification factor of the comparison circuit 201.

The auxiliary voltage source 102 is constructed by means of a Zener diode circuit.

The first controlled semiconductor switching element in this practical embodiment is constructed as a triac.

Figure 2:
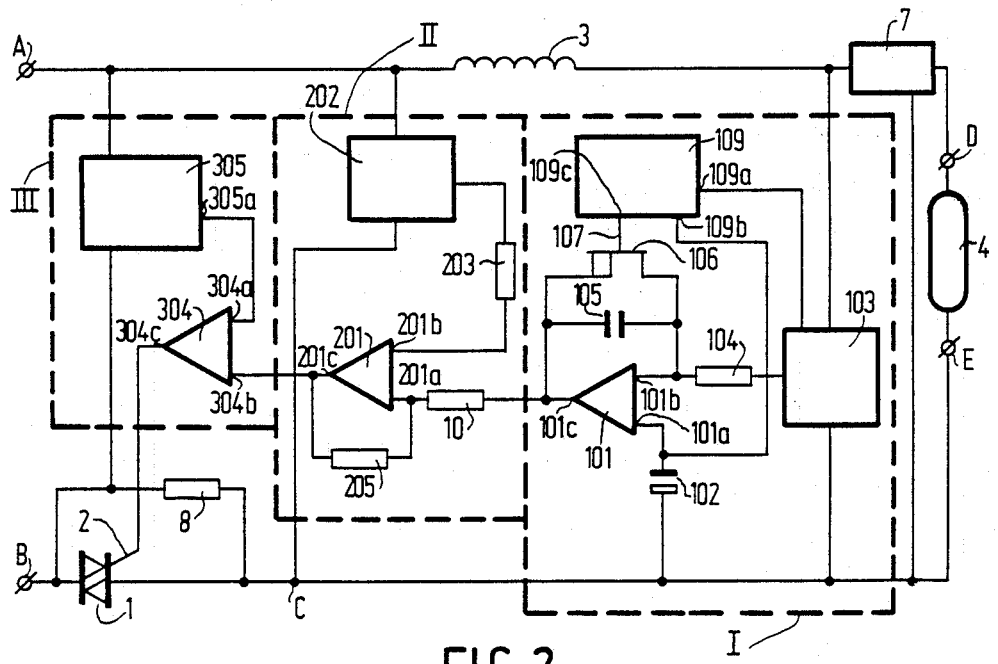
FIG. 2 shows a principle circuit diagram of a second embodiment of the circuit arrangement.

In the principle circuit diagram shown in FIG. 2, parts corresponding to FIG. 1 are provided with the same reference numerals. In this second embodiment, the controlled semiconductor switching element 1 is shunted by a resistor 8, which determines the keep-alive current. The control of the second controlled semiconductor switching element 106 takes place by means of an operational amplifier circuit 109 having an output terminal 109c connected to the control electrode 107 of the semiconductor circuit element 106. The operational amplifier circuit 109 is connected at an input terminal 109a to the voltage divider circuit 103, while an input terminal 109b is connected to the auxiliary voltage source 102 in order to obtain a comparison voltage. By preadjusted levels in the operational amplifier circuit 109, the switching element 106 is controlled so that the lamp voltage control becomes operative when the actual lamp voltage approaches the desired value.

The control circuit III in this embodiment comprises a circuit 305 for forming a sawtooth-shaped voltage by means of an opto-coupler, of which an output terminal 305a conveying the sawtootth-shaped voltage is connected to an input terminal 304a of a third comparison circuit 304. The opto-coupler then ensures that a D.C. separation is obtained. The output terminal 201c of the second comparison circuit 201 is connected to an input terminal 304b of the comparison circuit 304. Control pulses for controlling the semiconductor switching element 1 are formed from the signals at the input terminals 304a and 304b in the comparison circuit 304, for which purpose the output terminal 304c of the comparison circuit 304 is connected to the control electrode 2.

In a practical embodiment of a circuit arrangement as shown in FIG. 2, the comparison circuits 101,201 and 304 are constructed as operational amplifiers, the operational amplifier 101 being of the same type as in the case of the practical embodiment shown in FIG. 1.

The operational amplifiers 201 and 304 form part of a common integrated circuit of the type LM 324, trademark Philips.

The operational amplifier circuit 109 also comprises an integrated circuit of the type LM 324, trademark Philips.

The parts of the circuit arrangement denoted by reference numerals 102, 103, 104, 105, 106 and 202 have the same construction as in the case of the practical embodiment shown in FIG. 1.

A practical experiment has been carried out on high-pressure discharge lamps having the following characteristics:

With a life of 100 operating hours:
- lamp power 33 W
- lamp voltage $V_{la}$ 92 V Filling discharge vessel:
- amalgam
  - 28% by weight of Na
  - 72% by weight of Hg
- xenon,
- filling pressure 53 kPa colour temperature $T_c$ 2520 K.
colour rendition index $R_a$ 81
luminous efficacy 39 lm/W.

A first group of these lamps is operated for up to 6000 hours on a circuit arrangement according to the invention adjusted to a constant lamp voltage $V_{la}$ of 90 V. A second group is operated on a circuit arrangement according to the invention adjusted to a constant lamp voltage $V_{la}$ of 96 V. Measuring results are indicated in Table I. For comparison a third group of these lamps is operated in a conventional manner for 6000 hours. The measuring results thereof are indicated in Table II.

TABLE I

| | | | | | | | |
|---|---|---|---|---|---|---|---|
| lifetime (h) | 100 | 3000 | 5000 | 6000 | 100 | 3000 | 6000 |
| lamp voltage $V_{la}$ (V) | 90 | 90 | 90 | 90 | 96 | 96 | 96 |
| lamp power (W) | 32 | 37 | 36 | 35 | 33 | 39 | 37 |
| colour temperature $T_c$ (K) | 2460 | 2420 | 2380 | 2350 | 2550 | 2480 | 2380 |
| colour rendition-index $R_a$ | 82 | 82 | 81 | 81 | 81 | 82 | 81 |

TABLE II

| | | | | |
|---|---|---|---|---|
| lifetime (h) | 100 | 3000 | 5000 | 6000 |
| lamp voltage $V_{la}$ (V) | 92 | 82 | 78 | 77 |
| lamp power (W) | 33 | 31.5 | 31 | 31 |
| colour temperature $T_c$ (K) | 2520 | 2320 | 2260 | 2240 |
| colour rendition-index $R_a$ | 81 | 79 | 75 | 74 |

It appears from Tables I and Ii that the lamps operated in a circuit arrangement according to the invention exhibit after 6000 hours a considerably smaller variation of the colour temperature $T_c$ than conventionally operated lamps.

The nevertheless relatively large variation of the colour temperature $T_c$ in the second group of lamps can be explained, at least in part, by the operation of the lamp at a comparatively high lamp voltage $V_{la}$ of 96 V, the temperature of the amalgam being comparatively high so that phenomena leading to the disappearance of sodium exert a greater influence.

What is claimed is:

1. A circuit arrangement for operating at a supply voltage $V_n$ a high-pressure discharge lamp having a lamp voltage $V_{la}$ in conjunction with a current limiter circuit and with a first controlled semiconductor switching element provided with a control electrode connected to a control circuit of the circuit arrangement, characterized in that the circuit arrangement further comprises control means whereby the lamp voltage $V_{la}$ is kept substantially constant, said control means comprising a first part including a first comparison circuit for comparing a proportional part of the lamp voltage $V_{la}$ with a reference voltage $V_r$ and a second part including a second comparison circuit for comparing a proportional part of the supply voltage $V_n$ with the voltage at an output terminal of the first comparison circuit the second comparison circuit having an output terminal electrically connected to an input control terminal of the control circuit.

2. An arrangement as claimed in claim 1, characterized in that the first comparison circuit comprises a first integrator with an integration time $\tau_g \geqq 45$ s.

3. An arrangement as claimed in claim 1, characterized in that the second part of the circuit arrangement comprises a second integrator with an integration time $\tau_k \leqq 10$ ms.

4. An arrangement as claimed in claim 1, characterized in that the first comparison circuit is shunted by a second controlled semiconductor switching element which is conductive during starting and an associated transient phase up to stable operation of the lamp.

5. An arrangement as claimed in claim 4, characterized in that a control electrode of the second controlled semiconductor switching element is connected to an output terminal of a counter circuit having an input terminal connected to the control circuit.

6. An arrangement as claimed in claim 4, characterized in that a control electrode of the second controlled semiconductor switching element is connected to an output terminal of an operational amplifier circuit, which serves to compare a voltage across the lamp with an adjusted threshold value.

7. An arrangement as claimed in claim 1, wherein the control circuit comprises an opto-coupler and said reference voltage is adjustable so as to adjust the color temperature ($T_c$) of the lamp.

8. A circuit for operating a high-pressure discharge lamp having a lamp voltage comprising:

a pair of input terminals for connection to a supply voltage, means for connecting a current limiter and a first controlled semiconductor switching element in series with a high pressure discharge lamp across said input terminals, means connecting a control electrode of the semiconductor switching element to an output of a control circuit, and means for keeping the lamp voltage substantially constant comprising: a first circuit including a first comparison circuit for comparing a proportional part of the lamp voltage with a reference voltage, a second circuit including a second comparison circuit for comparing a proportional part of the supply voltage with a voltage at an output terminal of the first comparison circuit, and means electrically connecting an output terminal of the second comparison circuit to an input terminal of the control circuit.

9. A circuit as claimed in claim 8 wherein the first comparison circuit comprises a first integrator with an integration time $\tau_g \geqq 45$ s.

10. A circuit as claimed in claim 9 wherein the second circuit comprises a second integrator with an integration time $\tau_k \leqq 10$ ms.

11. A circuit as claimed in claim 10 wherein the first comparison circuit is shunted by a second controlled semiconductor switching element which is conductive during starting of the lamp and during an associated transient phase up to stable lamp operation.

12. A circuit as claimed in claim 9 wherein the first comparison circuit is shunted by a second controlled semiconductor switching element, and means coupled to a control electrode of the second semiconductor switching element to make it conductive during a starting phase of the lamp and during an associated transient phase that occurs prior to stable lamp operation.

13. A circuit for operating a high-pressure discharge lamp with a constant lamp voltage wherein the lamp is controlled from a source of supply voltage by means of a current limiter and a controlled semiconductor switching device, said circuit comprising:

a first comparison circuit for comparing a proportional part of the lamp voltage with a reference voltage that determines the nominal value of the lamp voltage, a second comparison circuit for comparing a proportional part of the supply voltage with a control voltage developed at an output of the first comparison circuit, and a control circuit having a control input coupled to an output of the second comparison circuit and an output for coupling to a control electrode of the controlled semiconductor switching device to control the operation thereof in a sense to maintain the lamp operating voltage substantially constant.

14. A circuit as claimed in claim 13 further comprising an integrator for deriving said proportional part of the supply voltage for application to one input of the second comparison circuit, said integrator having an integration time $\tau_k \leqq 10$ ms.

15. A circuit as claimed in claim 14 wherein the first comparison circuit comprises a second integrator with an integration time $\tau_g \geqq 45$ s.

16. A circuit as claimed in claim 13 further comprising a second controlled semiconductor switching device connected in shunt with the first comparison circuit, and means for applying a control signal to a control electrode of the second semiconductor switching device to make the second semiconductor switching device conductive during a starting phase of the lamp, during a following transient phase and up to stable operation of the lamp.

17. A circuit as claimed in claim 13 wherein the control circuit comprises a third comparison circuit having a first input coupled to receive the control voltage from the output of the second comparison circuit and a second input that receives a sawtooth voltage from a sawtooth generator, wherein an output of the third comparison circuit is coupled to said output of the control circuit to provide a control signal for controlling the operation of the controlled semiconductor switching device.

* * * * *